US006491516B1

(12) United States Patent
Tal et al.

(10) Patent No.: US 6,491,516 B1
(45) Date of Patent: Dec. 10, 2002

(54) ACTIVE HANUKKAH CANDELABRUM

(76) Inventors: Guy Tal, 86 Shilo St., Rosh Ha'Ain (IL), 48036; Ran Tal, 48 Brodesky St., Tel Aviv (IL), 69051

( * ) Notice: Subject to any disclaimer, the term of this patent is extended or adjusted under 35 U.S.C. 154(b) by 0 days.

(21) Appl. No.: 09/568,081

(22) Filed: May 9, 2000

Related U.S. Application Data

(60) Provisional application No. 60/136,771, filed on May 28, 1999, provisional application No. 60/136,767, filed on May 28, 1999, and provisional application No. 60/147,790, filed on Aug. 9, 1999.

(51) Int. Cl.[7] ..... F21V 35/00

(52) U.S. Cl. ..... 431/253; 340/577; 340/669; 273/147; 446/175; 362/806; 362/802; 40/411

(58) Field of Search ..... 431/253, 289, 431/295, 75; 340/577, 578, 579, 669; 273/147; 446/175, 256; 362/806, 253, 802, 276; 40/411, 414, 429, 430, 431, 442, 464, 465

(56) References Cited

U.S. PATENT DOCUMENTS

| | | | | |
|---|---|---|---|---|
| 3,762,857 | A | * 10/1973 | Andeweg | 431/253 |
| 4,044,499 | A | 8/1977 | Toler | |
| 4,080,753 | A | 3/1978 | Hiner et al. | |
| 4,178,714 | A | 12/1979 | Tsen et al. | |
| 4,327,518 | A | 5/1982 | Knauff | |
| 4,477,249 | A | 10/1984 | Ruzek | |
| 4,492,896 | A | 1/1985 | Jullien | |
| 4,525,821 | A | 6/1985 | Garcia | |
| 4,552,542 | A | 11/1985 | Reysman | |
| 4,568,209 | A | 2/1986 | Lin | |
| 4,568,303 | A | 2/1986 | Brown | |
| 4,755,135 | A | 7/1988 | Kwok | |
| 4,801,478 | A | 1/1989 | Greenblatt | |
| 4,804,323 | A | 2/1989 | Kim | |
| 4,867,727 | A | 9/1989 | Lanius | |
| 4,983,119 | A | 1/1991 | Lin | |
| 5,015,175 | A | 5/1991 | Lee | |
| 5,036,442 | A | 7/1991 | Brown | |
| 5,057,005 | A | 10/1991 | Kwok | |

(List continued on next page.)

OTHER PUBLICATIONS www.jrj.com.tw, Jun.–Aug. 2000.
www.jrj.com.tw/music_candle.html, Jun.–Aug. 2000
www.musical–candles.com, Jun.–Aug. 2000.

(List continued on next page.)

*Primary Examiner*—Sara Clarke
(74) *Attorney, Agent, or Firm*—David Pressman Attorney of Record

(57) ABSTRACT

A Hanukkiah (10) for carrying combustible candles (12) includes a sense circuit (16) coupled to an output circuit (18). The output circuit comprising at least one of an electronic playback device (112), an electromechanical device (52), or a light source device (46), or a combination thereof. Sense circuit (16) includes a flame-responsive circuit (16A) adapted and arranged to respond to a portion of energy emitted by a lit shamash (12A) candle of the Hanukkiah, and an RF receiver circuit (16B) adapted and arranged to respond to a portion of predetermined RF signal. A dreidel (200) is further provided comprising a rotation-sensitive RF transmitting circuit (230) for generating predetermined RF signals upon spinning of the dreidel. The flame of shamash (12A) and/or the spinning of dreidel (200) are adapted to activate output circuit (18) of Hanukkiah (10) to provide entertaining audible and/or visual output.

12 Claims, 6 Drawing Sheets

U.S. PATENT DOCUMENTS

| | | | | | |
|---|---|---|---|---|---|
| 5,069,617 | A | | 12/1991 | Lin | |
| 5,108,340 | A | | 4/1992 | Farrow | |
| 5,174,645 | A | | 12/1992 | Chung | |
| D344,146 | S | * | 2/1994 | Wilton et al. | D26/13 |
| 5,315,492 | A | | 5/1994 | Davenport | |
| 5,455,750 | A | | 10/1995 | Davis et al. | |
| 5,582,478 | A | | 12/1996 | Ambrosino | |
| 5,622,490 | A | | 4/1997 | Cheng | |
| 5,673,802 | A | | 10/1997 | Valentino | |
| 5,741,182 | A | * | 4/1998 | Lipps et al. | 463/36 |
| 5,791,966 | A | | 8/1998 | Capps et al. | |
| 5,807,096 | A | | 9/1998 | Shin et al. | |
| 5,820,251 | A | | 10/1998 | Greenberg et al. | |
| 5,881,482 | A | | 3/1999 | Goldman | |
| 5,921,767 | A | | 7/1999 | Song | |
| 6,053,622 | A | | 4/2000 | Horowitz | |

OTHER PUBLICATIONS www.speaktomecatalog.com/page/candel.htm, Jun.–Aug. 2000.

www.kordia.co.kr/idea.htm (37/1 +37/2), Jun.–Aug. 2000.

www.yo–yo.com/limited/index.html, Jun.–Aug. 2000.

www.yoyoplay.com (search for: "light"), Jun.–Aug. 2000.

www.spintastics.com/glow__in__the__yo–yes.asp, Jun.–Aug. 2000.

www.spintastics.com/super__spin__tops.asp, Jun.–Aug. 2000.

www.jewishsource.com (Hanukkah items available before Hanukkah–Dec.), Dec. 1999.

Question (and answer) sent to Mr. Don Olney of www.toy-crafter.com about Tops, Apr. 2000.

* cited by examiner

ACTIVE HANUKKAH CANDELABRUM

CROSS-REFERENCE TO RELATED APPLICATIONS

This application is entitled to the benefit of Provisional Patent Applications Ser. Nos. 60/136,771, filed May 28, 1999, 60/136,767, filed May 28, 1999, and 60/147,790, filed Aug. 09, 1999.

BACKGROUND

1. Field of Invention

This invention relates to entertaining devices and toys, particularly to interactive devices and toys for automatically supplying entertaining audible and/or visual output in response to a variety of occurrences, such as the spinning of a top and/or lighting of a candle.

2. Description of Prior Art

Hanukkah (also spelled Hanukka, Chanukkah, etc.; plural Hanukkiot) is a yearly Jewish festival started approximately 2000 years ago. The Hanukkah festival lasts eight days, mostly in December. Millions of Jews worldwide celebrate it; Hanukkah is a fun and joyous festival.

A Hanukkiah and a dreidel are two traditional devices used in Hanukkah. This invention is described in terms of such devices to emphasize its uniqueness and significance to its users, and over the prior art. Nevertheless, other embodiments and combinations employing the present invention are possible.

Hanukkiot: The first most visible aspect of the observance of Hanukkah is lighting of the candles of a special Hanukkah Menorah (candelabrum), called a Hanukkiah (also spelled Chanukkiah, Chanukia, or similar). The terms "Menorah" and "Hanukkiah" are often synonymously used, and are to be regarded as such throughout the specification and claims. Further the term "candle" is intended to define a generally conventional, combustible candle, made of wax, tallow, paraffin, or similar slow-burning material, and enclosing a combustible wick, unless the term "electrical candle" or "electric flame" is used.

Traditionally, the Hanukkiah is a multi-branched candelabrum holding up to nine candles in which one always stands out from the others, usually higher, or off to one side. Other than this there are no restrictions on the shape of a Hanukkiah, so artists can exercise a great deal of creativity in designing them. The candle that stands out is called the shamash (Hebrew: "servant", also spelled shammes, shammash, shammas, etc.). The shamash (also called shamash candle) is used to light the other or "day" candles, which represent the days of Hanukkah. The Hanukkiah includes nine open cups, recesses, or similar receptacles to hold the candles. Most Jewish homes worldwide have at least one Hanukkiah. During Hanukkah, family members light the candles of the Hanukkiah.

Ancient tradition prescribes a certain ceremony when lighting the candles. The ceremony is described here in detail to appreciate the invention fully. The ceremony is commonly conducted as follows: On the first night of Hanukkah, a first and new candle is placed at the far right of the Hanukkiah, in a holder. Next, a new shamash candle, being held by hand, is lit, e.g., by a match, and customary blessings are recited by the celebrants. During the recitation, the shamash is used to light the first candle. Then, the shamash is placed in its designated holder. At that time, it is customary to bless or sing to the words of Hanerot Hallalu (Hebrew), and sing the song Maoz Tzur (Hebrew)-also known as "Rock of Ages", to close down the lighting of the Hanukkiah ceremony for that night. The shamash and first candle are allowed to burn down. Thereafter, many Hanukkah songs are usually sung to celebrate the festival.

Similarly, on each night of Hanukkah, the ceremony is repeated. The burned-out candles from the day before are replaced by new ones, with one more day candle added each day, from right to left. The candles are lit and the songs and blessings are recited. The candles are usually lit by the shamash from left to right to honor to the newer candles first. On the eighth night of Hanukkah, all nine candles are lit. That concludes the festival and lighting ceremony. The lit candles are designed to burn a minimum of ½ hour and are allowed to burn down on their own.

Hanukkiot are made using a variety of materials, such as: glass, wood, plastics, ceramic, clay, stone, metal alloys, brass, gold, silver, etc. Their outer surface can be smooth, rough, engraved, molded, sculptured, machined, painted, etc., and they may be combined with various figurines.

Common Hanukkah candles are thin and long (tapers), usually 10 cm to 15 cm in length, though other dimensions are possible. The candles may be bought in a box that contain enough candles (>44) to last the eight nights of Hanukkah, allowing daily replacement. The candles are secured at the lower parts in their receptacles. The receptacles are designed to easily receive the candles so the user will have no difficulty replacing the candles each day without tools.

The most common and dominant Hanukkiot that can be found in the markets are those adapted to hold candles. The Judaica market is full of beautiful Hanukkiot, designed by many artists. Each year new designs appear. With some Hanukkiot, small oil lamps with floating wicks replace the candles.

Some Hanukkiot designs serve no practical function. These include two-dimensional pictorial illustrations of Hanukkiot, appearing mostly on cloth wall hangings, paintings, post cards, greeting cards, drawings, etc. Of course, pictorial Hanukkiot are not designed to hold combustible candles; they serve as passive ornaments.

A few weeks prior to Hanukkah, children are taught all about Hanukkah in every Jewish school around the world. They learn about the history involved, customs, foods, songs, blessings, and traditional stories. One or more Hanukkiah is placed for display in most classrooms. Further, Hanukkiot design exhibitions and competitions are held in schools.

Over the years, there has been little advancement with regard to Hanukkiot, apart from their artistic design. The majority of advancement has been in providing electric Hanukkiot. These include nine electric light bulbs or LEDs serving as electric candles or flames, and operated by an electric switch or switches. Electric Hanukkiot are relatively remote to the Hanukkah tradition.

The following patents relate to electric Hanukkiah (Menorah):

U.S. Pat. No. 6,053,622 to Horowitz et al, Apr. 25, 2000, describes a wand activated electric Menorah.

U.S. Pat. No. 5,881,482 to Goldman, Mar. 16, 1999, describes a display device illustrating only a pictorial representation of a Menorah. It optionally includes an electronic circuit to operate a solenoid for advancing an indexed wheel indicating the day of Hanukkah.

U.S. Pat. No. 5,820,251 to Michael et al, Oct. 13, 1998, describes a two-dimensional, electrically illuminated, ornamental device.

U.S. Pat. No. 5,315,492 to Donald, May 24, 1994, describes an electric Menorah that includes electric flames, and an electronic music sound chip operated by a switch.

U.S. Pat. 4,492,896 to Graham, Jan. 8, 1985, describes an electronic candle system where electric candles (light bulbs) are lighted on a touch of a hand-held wand.

Further, patented prior art that relate to general musical electric candles include:

U.S. Pat. No. 5,582,478 to Donald, Dec. 10, 1996, describes a food covering system that includes electric candles, and/or moving decorations, and/or a music device that are controlled by a switch, a microcontroller, and by a breath sensor.

U.S. Pat. No. 5,455,750 to Lewis et al. Oct. 3, 1995, describes an, artificial tree with scent, sound and electric lights.

U.S. Pat. No. 5,174,645 to Martin, Dec. 29, 1992, describes an electric candle and music that are operated by a sound pick-up and shut by a breath sensor.

Still further, patented prior art that relate to musical, combustible, candles include the following:

A single candle having a light, heat or other sensing means embedded inside it, mostly along its wick, and being coupled to a music-producing circuit is shown in the following patents: U.S. Pat. No. 5,921,767 to Jin, Jul. 13, 1999; U.S. Pat. No. 5,069,617, Dec. 3, 1991 and U.S. Pat. No. 4,983,119, Jan. 8, 1991 to Lin; U.S. Pat. No. 5,807,096 to Shin et al. Sep. 15, 1998; U.S. Pat. No, 5,015,175 to Lee, May 14, 1991; U.S. Pat. No. 4,477,249 to Ruzek et al, Oct. 16, 1984; U.S. Pat. No. 4,804,323 to Kim, Feb. 14, 1989; and U.S. Pat. No. 4,568,269 to Lin, Feb. 4, 1986. All of these relate to unique candles, where a flame sensing mechanism is located inside the candle, or wrapped around it.

U.S. Pat. No. 4,755,135, Jul. 5, 1988, and U.S. Pat. No. 5,057,005, Oct. 15, 1991 to Kwok both show a musical candle device where a candle (except for its wick) is fully enclosed in a matching container. Music switching mechanism includes a thermal-conducting wire, an optical guide, or a photosensitive resistor being external to the candle to detect a flame. No provision is described for detecting the flame of an easily replaceable, non-confined, lit candle, as used with a Hanukkiah. The candle shown is replaced by opening a lid in the container. The candle and container have to match in their dimensions, and are shown in an awkward combination comprising many parts. Lastly, the flame detection arrangement described cannot identify when, say, the candle is just half-way or nearly all consumed—to switch-on the music circuit; therefore, the disclosed flame detection arrangement is limited in its application. Further, no provision is there for operating other electronic circuits by the flame.

A simple On/Off switch-operated musical candle device and holder, is shown in U.S. Pat. No. 5,673,802 to Valentino, Oct. 7, 1997; U.S. Pat. No. 4,801,478 to Greenblatt,: Jan. 31, 1989; U.S. Pat. No. 5,622,490 to Chak, Apr. 22, 1997; and. U.S. Pat. No. 4,525,821 to Garcia, Jun. 25, 1985.

All of the above secular candles and Hanukkiot are relatively prosaic and do relatively little to stimulate the interest of children and adults.

The only advancement found that relates to candle-carrying Hanukkiot include those comprising a mechanical wind-up melody mechanism-a music box drum. The drum is manually wound for operation, and started by hand-sliding a small lever. It usually plays the tune Maoz Tzur by individual notes. The disadvantage of these Hanukkiot is in the use of the old-fashioned mechanical wind-up mechanism. It is generally unreliable, prone to breakage, and monotonous. Further, it must be manually wound prior to use, and it plays only musical notes. This mechanism has also been incorporated in electric Hanukkiot.

Dreidels: Another important visible aspect of Hanukkah is the playful use of a dreidel (also spelled Draydel, or similar). Traditionally, a dreidel is a four-sided top with a Hebrew letter on each side (though other embodiments are possible). The dreidel is playfully used in Hanukkah by children and adults alike. It is usually spun by hand on a table or floor, for as long as possible.

Dreidels are made using a variety of materials, such as: glass, wood, plastics, ceramic, clay, stone, metal alloys, brass, gold, silver, etc. Artists exercise a great deal of creativity in designing them. As with Hanukkiot, each year new designs appear.

Over the years, there has been some technological advancement with regard to dreidels. Prior art dreidels and tops include a rotation-sensitive sound and light generating mechanism. More recent ones have a sequence of lighting patterns created by LEDs. There is also a top that records a few seconds of sound and will replay it when spinning, and another one that plays a traditional dreidel song, and says the Hebrew letter when it falls over.

The following patents describe playful devices for electronically emitting an output upon rotation or revolution:

U.S. Pat. No. 4,080,753 to William et al, Mar. 28, 1978, describes a sound generating flying saucer.

U.S. Pat. No. 4,178,714 to John et al, Dec. 18, 1979, describes alighted and sounding toy, yo-yo, actuated by a centrifugal-switch.

U.S. Pat. No. 4,327,518 to Robert, May 4, 1982, describes an inertial device for sight and sound effects in rotating apparatus.

U.S. Pat. No. 4,552,542 to Marjan, Nov. 12, 1985, describes an illuminating spinning disc toy.

U.S. Pat. No. 4,568,303 to Paul, Feb. 4, 1986, describes a toy for electrically playing rhythmical melody upon rotation or revolution thereof.

U.S. Pat. No. 4,867,727 to Lanius, Sep. 19, 1989, describes a toy including centrifugal-switch.

U.S. Pat. No. 5,791,966 to Stephen et al, Aug. 11, 1998, describes a rotating toy, such as a top or yo-yo, with electronic display mechanism that permits the display of letters.

Other playful items of rotation include:

U.S. Pat. No. 4,044,499 to Jacob, Aug. 30, 1977, describes a whirl toy having means for lighting a light when the toy is whirled about in a circular path.

U.S. Pat. No. 5,036,442 to Joseph, Jul. 30, 1991, describes an illuminating wand.

U.S. Pat. No. 5,108,340 to Madelyn, Apr. 28, 1992, describes a: musical and lighted Hula Hoop.

Also, the markets include a large range of responsive devices and toys that respond to external events to perform some entertaining output. These external events include light, sound, and motion, radio-frequency, infra-red, and ultrasonic sound detection, etc.; and complementary entertaining output include light switching, toy movement, sound output etc. To summarize, there exist a variety of candle devices, responsive devices for providing an entertaining output, and spinning or rotating devices for providing an output. However, there exist no operative association of such devices, let alone one that involves a Hanukkiah and a dreidel pair.

OBJECTS AND ADVANTAGES

Accordingly, several objects and advantages of the invention are to provide:

- a new entertaining device and a toy concept, and
- a device of the foregoing type which involves an operational association between a responsive entertaining device and a transmitting spinning/rotating device, and
- a device of the foregoing type where the concept is embodied in a Hanukkiah and dreidel pair.

Other objects and advantages are:

- to provide an active Hanukkiah comprising audible, motional and/or light output, for entertaining users through the sense of sound and sight;
- to provide a Hanukkiah for complementing the Hanukkah candle lighting ceremony by automatically supplying the closing song of Maoz Tzur as the shamash is traditionally placed in its holder, and for providing the correct lyrics of Hanukkah songs and assist the gatherings in pacing their singing;
- to provide a way to surprise someone who first use such Hanukkiah, and who is unfamiliar with its features;
- to provide an improved teaching, motional, and entertainment tool for Hanukkah;
- to provide a Hanukkiah being responsive to a predetermined remote occurrence for activating its entertaining outputs;
- to provide a transmitting dreidel, complementary to the responsive Hanukkiah, for remotely controlling at least one of the Hanukkiah's entertaining outputs upon its spinning;
- to provide such transmitting spinning device for remotely controlling other responsive devices; and
- to provide a plurality of electrical and mechanical building blocks for each of the mentioned devices to provide wide range of combinations, allowing a large market selection.

Still further objects and advantages will become apparent from a consideration of the drawings and ensuing description.

DRAWINGS

Figure 1:
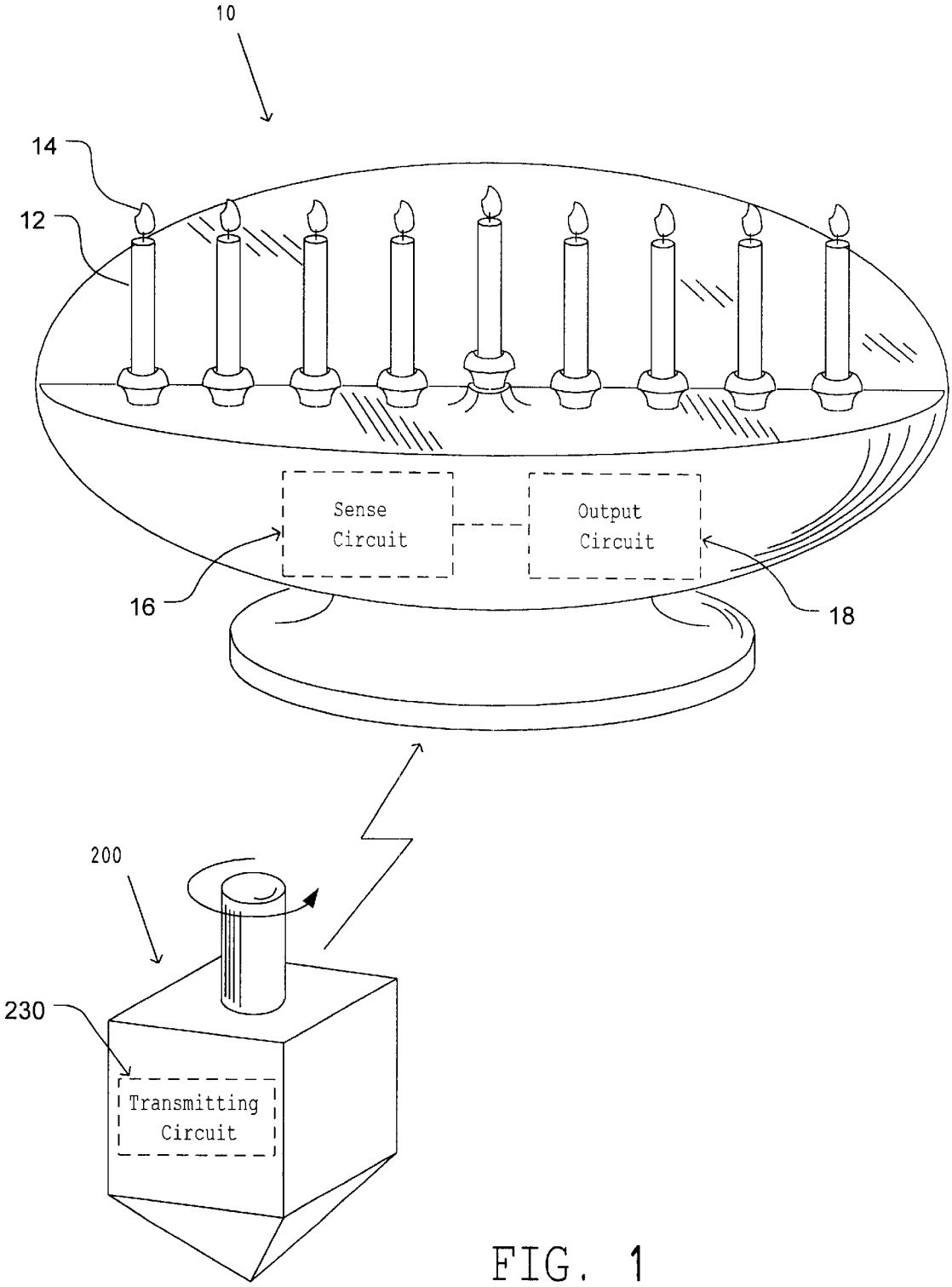
FIG. 1 is a front elevation of a Hanukkiah for carrying candles, and a dreidel according to the invention.

| Reference Numerals |
|---|
| 10 first Hanukkiah |
| 10A second Hanukkiah |
| 12 day candle |
| 12A shamash candle |
| 14 candle flame |
| 14A shamash flame |
| 16 sense circuit |
| 16A flame-responsive circuit |
| 16B RF receiver circuit |
| 16C IR receiver circuit |
| 16D ultrasonic receiver circuit |
| 16E sound-responsive circuit |
| 16F switch circuit |
| 18 output circuit |
| 20 main body of first Hanukkiah |
| 20A main body of second Hanukkiah |
| 22 raised upper back |
| 24 base |
| 26 raised body portion |
| 28 slit |
| 30 speaker grille |
| 32A–D and 32F–I candle holders |
| 32E shamash candle holder |
| 32E' elongated shamash candle holder |
| 32F' elongated candle holder |
| 38 display dreidel |
| 40 and 40A rod |
| 42 transparent opening |
| 44 tempo/volume button |
| 44A tempo/volume potentiometer |
| 46 light source device |
| 48 "Happy Hanukkah" light output |
| 50 and 50A–50E opening |
| 52 electromechanical device |
| 54 speaker |
| 56 Hanukkiah electronic circuit board |
| 58 fastener |
| 60 sensor |
| 72 energy conductor |
| 74 receiving end |
| 78 reflector |
| 80 reflector holder |
| 90 portion of a Hanukkiah's body |
| 92 Star of David |
| 96 flexible coupler |
| 98 camshaft |
| 100 sleeve |
| 102 sign |
| 104 lever system |
| 110 and 110A sense circuit output line |
| 112 playback device |
| 114 Hanukkiah power source |
| 116 electromechanical device driver |
| 118 light source device driver |
| 120 connection line |
| 130 control circuit |
| 132 and 132A to 132C control circuit output line |
| 140 RF receiver |
| 142 RF antenna |
| 150 IR receiver |
| 152 IR detector |
| 160 ultrasonic receiver |
| 162 ultrasonic transducer |
| 170 sound detector |

-continued

| Reference Numerals |
|---|
| 172 audio sound transducer |
| 180 switch |
| 200 dreidel |
| 202 main body of dreidel |
| 204 aperture |
| 210 top |
| 212 main body of top |
| 220 yo-yo |
| 222 main body of yo-yo |
| 230 transmitting circuit |
| 230A IR transmitting circuit |
| 230B ultrasonic transmitting circuit |
| 232 centrifugal-switch |
| 234 RF transmitter |
| 236 RF antenna |
| 238 transmitter power source |
| 240 IR transmitter |
| 242 IR emitter |
| 250 ultrasonic transmitter |
| 252 ultrasonic emitter |

SUMMARY

A new entertaining device and toy provides an association between a responsive entertaining device and a transmitting spinning or rotating device. A candle-carrying Hanukkiah includes a sense circuit and an output circuit, and a dreidel includes a rotation-sensitive transmitting circuit. The Hanukkiah's sense circuit comprises both a flame-responsive circuit, adapted to respond to one of a flame's emissions originating from a lit candle of the Hanukkiah, and a receiver circuit adapted to respond to predetermined incoming signals. The dreidel transmits signals upon spinning to be responded to by the receiver circuit of the Hanukkiah. The output circuit of the Hanukkiah is responsive to the flame-responsive circuit and the receiver circuit for producing at least one humanly sensible entertaining output. The output circuit comprises at least one of an electronic sound-producing circuit, a motion-producing circuit, and a light-producing circuit.

Description—Basic Hanukkiah and Dreidel-FIG. 1

FIG. 1 illustrates a Hanukkiah assembly (also called simply Hanukkiah) and a dreidel, including a schematic illustration of some of their basic building blocks or elements, according to the invention. A candle-carrying Hanukkiah 10 includes a row of candles and respective flames, such as candle 12 and flame 14, and a sense circuit 16 and an output circuit 18. A dreidel 200 includes a rotation-sensitive transmitting circuit 230.

The following description first covers the Hanukkiah and its operation, then the dreidel, and finally the combination.

Figure 2A:
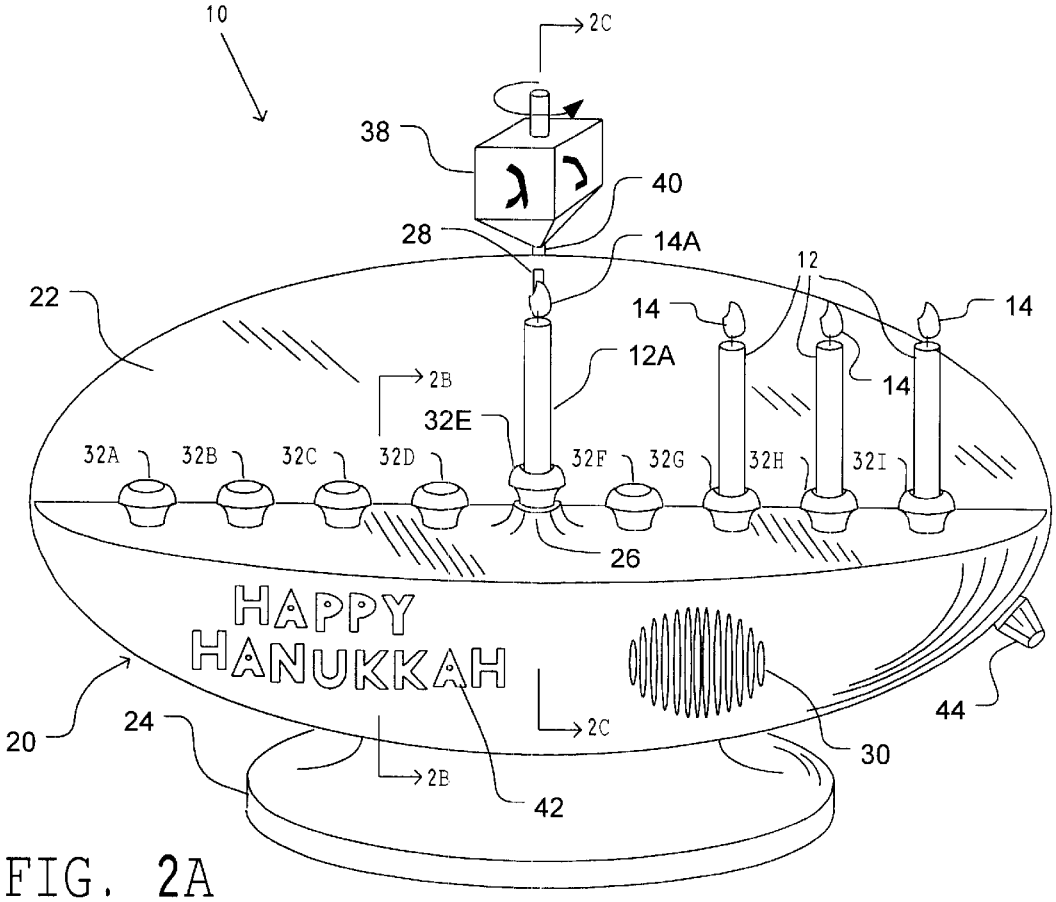
FIG. 2A is a similar view illustrating several entertaining outputs from the Hanukkiah.
Figure 2B:
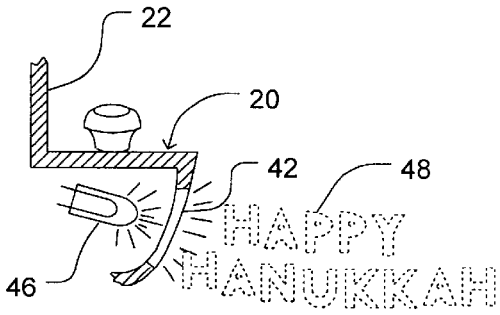
FIG. 2B is a partial sectional view of the Hanukkiah of FIG. 2A, illustrating an internal light source.
Figure 2C:
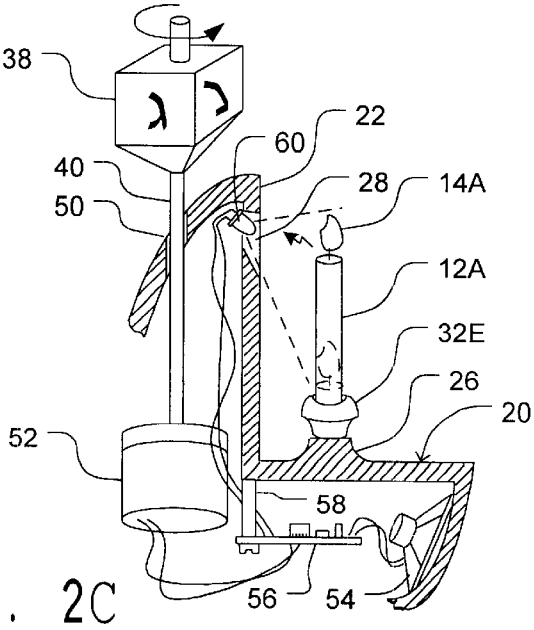
FIG. 2C is a partial sectional view of the Hanukkiah of FIG. 2A, illustrating an internal portion of an output circuit.

Description—Preferred Embodiment Of Hanukkiah-FIGS. 2*a* to 2*c*

A candle's flame emits a plurality of energies in the form of optical and thermal radiation, of different wavelengths, as well as gaseous energy. Commercially available sensors and transducers may be used to detect portions of energy of any such emissions. A photosensitive device, such as an Infra-Red (IR) diode or transistor detector, a photo-resistor or a solar cell, may be used to detect portions of optical energy emitted from the flame. A thennal-sensitive device, such as a thermistor, a thermocouple, or a semiconductor junction of a diode or transistor, may be used to detect portions of thermal energy emitted from the flame. A smoke-sensitive device, such as photoelectric sensor or an ionizing sensor, may be used to detect portions of smoke/fumes energy emitted from the flame. Any and all sensors and devices described, and circuits that include such devices, are termed "flame-responsive" sensors, devices, and circuits. In other words, a flame-responsive sensor, device or circuit is one that is electrically responsive to at least one of a flame's emissions as described above.

FIGS. 2A to 2C shows portions of a preferred candle-carrying Hanukkiah 10 combined with an embodiment of output circuit 18 and sense circuit 16.

FIG. 2A illustrates an assembly including Hanukkiah 10 comprising a substantially hollow (not shown) main body 20, supported by a base 24, and a raised upper back 22 extending vertically from the main body. Additionally, on the main body is a row of nine equally-spaced (by tradition) candle holders 32A to 32I. Among those, is a shamash candle holder 32E shown above the other holders by a raised body portion 26. Shamash holder 32E is designated to receive a shamash candle 12A. Also shown are a shamash flame 14A, and three lit day candles 12, representing the first three days of Hanukkah.

The assembly further includes a speaker grill 30 in the front portion, to allow sound passage. A display dreidel 38 is secured externally, by a rod 40, on the raised upper back behind the shamash candle and above it. The dreidel is shown with symbolic Hebrew letters (not numbered). The rod and dreidel are arranged to revolve around a vertical turning axes. A plurality of optically transparent openings 42 are formed as letters or symbols in the main body to allow light to pass out from inside.

A vertical slit 28 is shown located in the center front of the raised upper back, positioned above shamash candle holder 32E. The slit being, say, 25 mm L by 3 mm W rectangle, has its upper part slightly above the height of the expected flame of a new lit shamash candle when secured in its holder 32E. For example, if the Hanukkiah is designed to receive 10-cm long Hanukkah candles, then the slit's upper part is located approximately 10.5 cm above the shamash holder.

A tempo/volume control button 44 is provided to allow a user to adjust the tempo and volume of a played output.

FIG. 2B is a partial sectional view of the Hanukkiah of FIG. 2A, illustrating a portion of the inner cavity (not numbered) of the main body where at least one light source device 46 is disposed. The light source device is located substantially behind transparent opening 42 for emitting light so that it is visible outside the main body. The transparent opening may include a transparent window, such as colored plastic or glass, to provide colored light output. As shown, the transparent opening is formed to provide a "Happy Hanukkah" visual light output 48.

FIG. 2C shows another sectional view of the assembly of FIG. 2A, illustrating a portion of the inner cavity of the main body and the raised upper back, in which disposed are an electromechanical device 52, an electronic circuit board 56, and a speaker 54. The electromechanical device is coupled to rod 40 which projects through opening 50 at the backside of raised upper back 22. The electronic circuit board is secured internally by a fastener 58. Speaker 54 is secured internally directly behind speaker grille 30 (FIG. 2A).

Further shown in FIG. 2C is a sensor 60 disposed in slit 28 facing the exterior of the Hanukkiah. Sensor 60 is a flame-responsive device preferably being an IR transistor detector for detecting portions of IR light emission from a flame. The sensor is located at the upper part of the slit, fully inside it, and inclined towards the middle of the shamash. The length of the slit (25 mm), the position and angle of the sensor, and the sensor's receiving angle allows the sensor to receive light from the shamash flame for as long as the shamash is lit—as it get consumed (a consumed shamash is shown dotted in FIG. 2C inside shamash 12A). This slit and sensor configuration allows also reduced overhead ambient light from striking the sensor; and the width of the slit (3 mm) allows mostly direct light emission in front of it to strike the sensor, thus reducing receiving light emission from nearby day candles.

The Hanukkiah may be made of any material available for mass production, such as plastic, ceramic, glass, clay, wood, metal, etc.

Figure 5A:
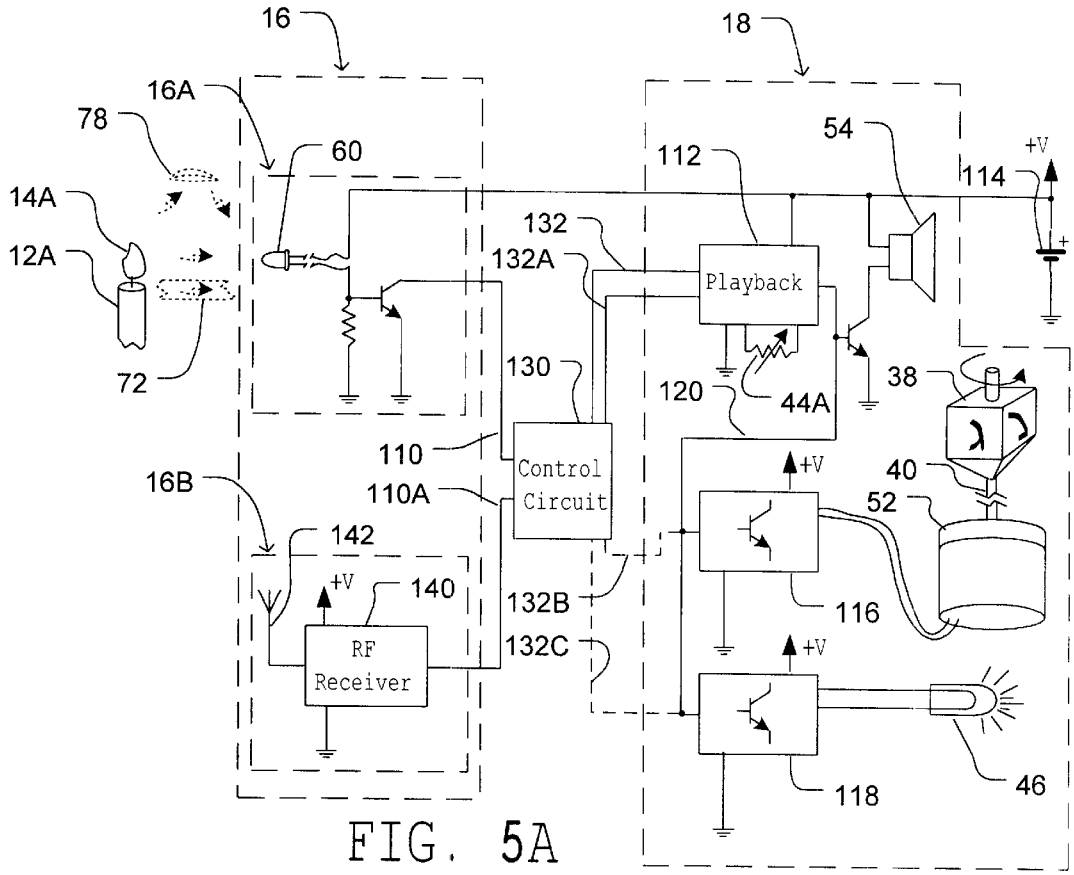
FIG. 5A shows an electronic circuit used in the Hanukkiah.

Description—Preferred Hanukkiah Circuit-FIG. 5*a*

FIG. 5A illustrates a preferred electronic circuit used in the Hanukkiah. It includes sense circuit 16 operatively coupled to output circuit 18 through a control circuit 130. The circuit is generally assembled as circuit board 56 (FIG. 2C).

The preferred sense circuit 16 comprises two sense circuits being a flame-responsive circuit 16A, configured to respond to flame 14A of shamash candle 12A, and a Radio-Frequency (RF) receiver circuit 16B, adapted to respond to a predetermined RF signal.

Flame-responsive circuit 16A comprises sensor 60 coupled to an amplifier device (not numbered) for providing a sense output. The sense output of the circuit is carried on line 110 into control circuit 130.

RF receiver circuit 16B comprises an RF antenna 142 coupled to an RF receiver 140. The RF receiver is preferably selected from the family of commercially available RF remote control receiver ICs and circuitry, and/or from any combination of transistor circuits, high-frequency amplifiers and detectors, etc. It is adapted to respond to predetermined coded, pulsed, modulated or carrier RF signal for providing a receiver output. The receiver output is carried on line 110A into control circuit 130. The antenna used comprising a portion of a printed circuit conductor, a loose conducting wire disposed in the Hanukkiah, or similar.

Control circuit 130 receives the output signals from the preceding circuits and acts, under a predetermined combination and timing of these signals, to provide at least one control output signal on at least one of lines 132 and 132A to 132C. These are coupled to output circuit 18. The plurality of the control circuit output signals/lines provides a way to selectively control any of the circuits included in output circuit 18. Control circuit 130 comprises any combination of logic gates, transistors, or diode combinations, timing devices, microcontroller circuits, and/or simple wiring.

Output circuit 18 preferably comprises few building blocks. They are an audible sound-producing circuit, a motion-producing circuit, or a light-producing circuit or a combination of such circuits. These circuits are not numbered. Specifically, the sound-producing circuit preferably comprises a playback device 112 coupled to speaker 54 for providing audible sounds output; the motion-producing circuit preferably includes electromechanical device 52 and at least one coupled movable member, say, display dreidel 38, for initiating or controlling visual motion associated with the Hanukkiah; the light-producing circuit preferably includes light bulb 46 for providing entertaining, non-flame simulating, visual light effects.

Lines 132 and 132A are shown coupled to playback device 112 of output circuit 18. The playback device is shown connected, via connection line 120, to both an electromechanical device driver 116, for driving electromechanical device 52, and to a light source device driver 118 for driving light source device 46. This connection causes both drivers, and their respective output devices, to operate synchronously with the playback device.

A Hanukkiah power source 114 provides electric power to the electronic circuits. It preferably comprises AA or AAA batteries, or a power supply connected to the AC mains. The current consumption of the electronic circuit is very small, thus eliminating the need for an On/Off switch.

Also, tempo/volume control button 44 (FIG. 2A) is coupled (not shown) to a tempo/volume potentiometer 44A which is in turn coupled to the playback device, for controlling the tempo or volume (to be determined by the manufacturer) of the audible output.

Playback device 112 is preferably a single-chip music/voice synthesizer IC having multiple memory sections for storing a plurality of different musical scores. It is shown with two input lines (addresses) connectable to lines 132 and 132A, for selecting several different musical scores. Such ICs are available from various semiconductor manufacturers. They are low cost, have low-current consumption, and use an internally masked memory. The memory stores a representation of the desired musical score. The IC chosen should contain large enough memory to store lengthy musical selections. A combination of such ICs may be needed to provide an adequate playback time, or other playback ICs, having external memory, may be selected, or ICs able to decompress compressed audio signals, as MP3, that are stored therein. Furthermore, a melody-generator IC, employing tone generator(s) with preprogrammed melody is also acceptable. Still further, a single record and playback IC, having and an internal or external digital or analog memory, whereby the user can make a recording of singing (using a microphone) for later reproduction, may be alternatively used. Such ICs may also be programmed by the manufacturer for playback purposes only.

Electromechanical device 52 is any device or system for converting electrical energy into mechanical energy/motion. The preferred electromechanical device is a small, geared, DC electric motor.

Light source device 46 is any device or system for converting electrical energy into light energy. It preferably comprises an incandescent light bulb, or LED, or a combination. Alternatively, the light source comprises a device for manipulating light energy, as a reflective alphanumeric LCD; driver 118 is selected accordingly.

Electromechanical device driver 116 and light source display driver 118 may each include a single transistor, a Darlington transistor, a combination, an adequate IC driver device, or the like.

Operation—Hanukkiah-FIGS. 2*a* to 2*c* And FIG. 5*a*

There are numerous operational modes conceivable with the Hanukkiah disclosed. In a preferable operational mode, whenever a lit shamash candle is placed in its candle holder, and no RF is detected, the musical score of Maoz Tzur is played once, and entertaining output motion and light are activated. Further, whenever a predetermined RF signal is received, and no flame is detected, a second Hanukkah musical score is played, and motion and light are activated. Still further, whenever both the shamash's flame is detected and an RF signal is received, a third musical score is played, and motion and light are activated.

Described more specifically, sensor 60 is responsive to flame 114A of lit shamash candle 12A, through slit 28, when placed in its designated holder 32E. An increase in IR light energy upon the sensor causes an increase in current through it. Above a predetermined light and corresponding current level, flame-responsive circuit 16A issues a low-going signal at line 110; if line 110A is inactive (no RF detected), the control circuit is designed to issue a control output signal on line 132 to trigger output circuit 18 into operation. Playback device 112 is then triggered to produce a first musical score through speaker 54. Synchronous with the played music, through line 120, electromechanical device driver 116 and light source device driver 118 are triggered to drive both electromechanical device 52 and light source device 46 into operation, thus providing a revolving display dreidel 38 and a lighted "Happy Hanukkah" display 48, respectively. (Common playback devices output some DC voltage while playing. This DC voltage, carried on line 120, activates the coupled drivers.)

Further, when RF receiver circuit 16B receives a predetermined RF signal, it responds by providing a receiver output signal on line 110A; if no flame is detected (line 110 is inactive). The control circuit then issues a control output signal on line 132A, rather than on line 132, for triggering the playback device to produce a second musical score, and operating the rest of the output circuit.

Still further, for as long as flame 14A is detected and each time a predetermined RF signal is received by the RF receiver circuit, the control circuit issues a control output signal on both lines 132 and 132A. These trigger the playback device to produce a third musical score, and to operate the rest of the output circuit. This can be done when the control circuit is an AND gate and/or has a logic AND function.

Complementary to the operational modes described above, a programmable feature of a typical playback device allows its triggering on a "first to come" signals on one of its inputs (connected to lines 132 and 132A), and further allows playback to completion of a musical score, thus avoiding playback interruption by an event while at play.

Optional control circuit output lines 132B and 132C (shown dotted) provide selected control over the operation of electromechanical device driver 116 and light source device driver 118—if no playback device is used, or if no parallel operation is desired between any or all the output circuits. Connection line 120 is then deleted, and the control circuit is adapted accordingly (not shown). Such selected control allows even more entertaining operational modes with the Hanukkiah.

Figure 3A:
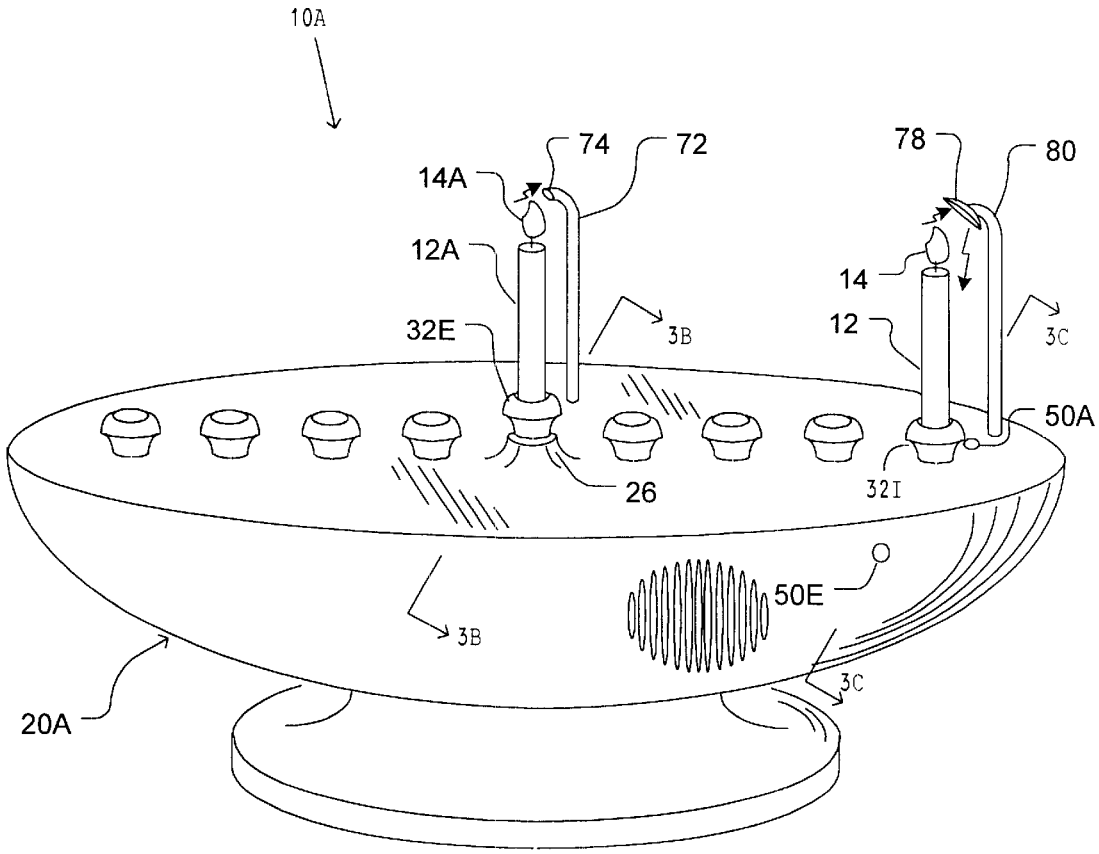
FIG. 3A is a front view of an alternative Hanukkiah embodiment, illustrating alternative flame detection arrangements.
Figure 3B:
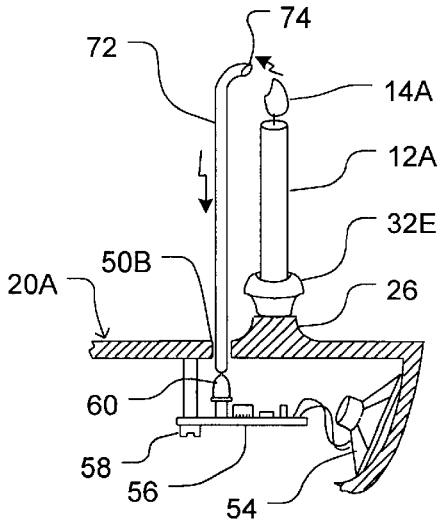
FIG. 3B is a partial sectional view of the Hanukkiah of FIG. 3A, illustrating an energy conductor used in the Hanukkiah.

Flame Detection Using Energy Conductor—FIGS. 3*a* and 3*b*

FIG. 3A shows a second example of a Hanukkiah 10A having a main body 20A and carrying two alternative flame detection arrangements using sensor 60.

In FIG. 3A and FIG. 3B an energy conductor 72 is used as a medium to transfer and conduct at least one of a flame's energy emissions to the sensor. FIG. 3B shows the conductor emerging vertically from within the main body, through opening 50B, to the approximate expected height of a new (unconsumed) shamash's flame. The conductor has a top receiving end 74 located near the flame, and the sensor located at its opposite end. The sensor receives heat, light, or hot gases from the flame.

The preferred sensor is the IR transistor detector previously discussed, and the preferred conductor is a photo-energy conductor generally consisting of a clear glass or plastic fiber rod. Light energy from the flame enters through receiving end 74 and is conducted to the sensor. FIG. 3B shows the sensor located on circuit board 56 disposed in main body 20A. The conductor shown is bent at its receiving end in a way to avoid light from nearby candles and overhead ambient light from affecting the sensor.

The electronic circuit of FIG. 5A may be used. FIG. 5A shows conductor 72 (broken lines) being optically located between flame 14A and sensor 60. Consequently, using an energy conductor, the Hanukkiah's artistic designer may have more freedom in designing various embodiments since the sensor is located away from the flame, and the conductor may also be used artistically.

The energy conductor is chosen according to the desired sensor 60. If a thermal-sensitive sensor is used, the conductor may comprise a good thermal-conductor, such as aluminum. Flame 14A heats receiving end 74 and the heat is conducted to the thermal sensor coupled on its opposite end.

Alternatively, if gaseous emission detection is chosen, the sensor is selected accordingly, and the conductor may comprise a fumes-conductor, as a hollow metal tube or pipe. Fractions of the flame's smoke will penetrate the receiving open end of the conductor, which will conduct them to the sensor.

Figure 3C:
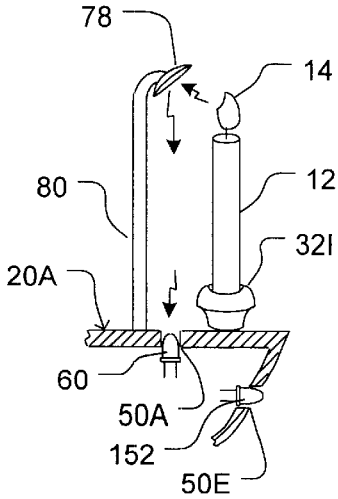
FIG. 3C is a partial sectional view of the Hanukkiah of FIG. 3A, illustrating an energy reflector used in the Hanukkiah.

Flame Detection Using Reflector—FIGS. 3*a* and 3*c*

FIG. 3A and 3C show another flame detection arrangement using a photo reflector 78 which is raised and supported by an elongated, vertical reflector holder 80. The reflector is positioned to transfer and reflect photo energy from the flame of a candle, secured in holder 32I, to the sensor disposed in opening 50A below (FIG. 3C)—facing the reflector. The flame, reflector, and sensor are on one broken optical axis. Again, the sensor used is an IR detector.

The reflector may have a convex shape, be flat, or may comprise of several chained reflectors. It may comprise reflective glass, plastic or metal, or a combination.

Again, the circuit illustrated in FIG. 5A may be used with reflector 78 (shown in broken lines).

The reflector and sensor may alternatively be held in a different manner. For example, the reflector may be located on the raised upper back 22 of the holder of FIG. 2A, or be part of an artistic design of the Hanukkiah.

Figure 4A:
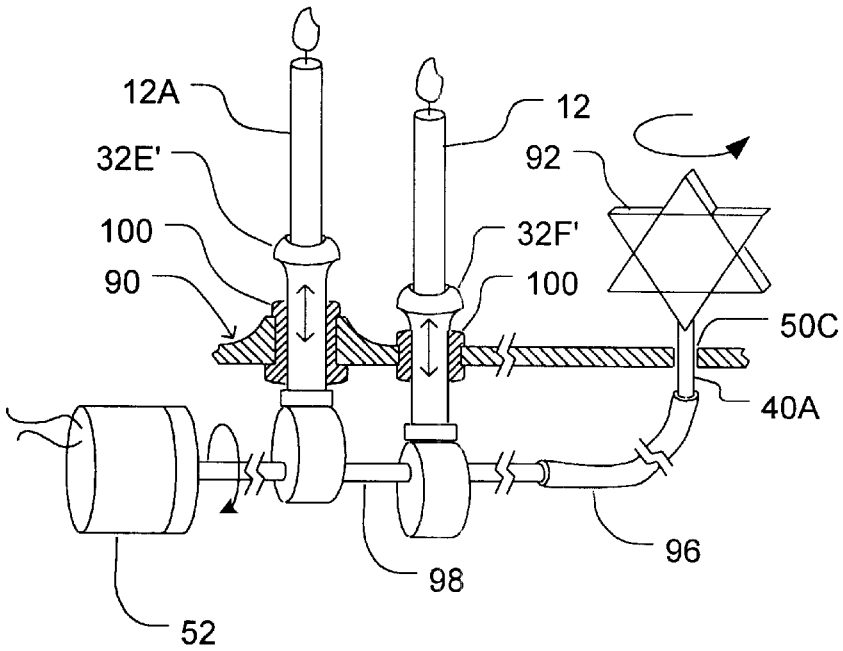
FIG. 4A illustrates another motion-producing arrangement associated with the Hanukkiah.
Figure 4B:
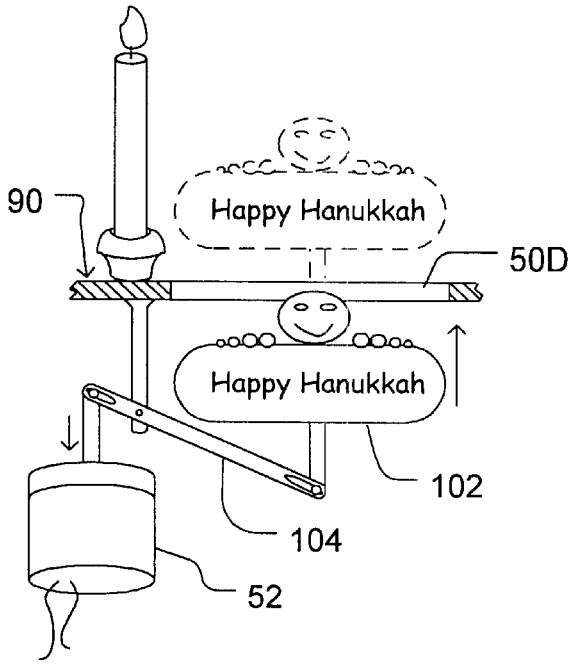
FIG. 4B shows yet another motion-producing arrangement.

Alternative Motion-Producing Arrangements—FIGS. 4*a* and 4*b*

For associating motion with the Hanukkiah, FIG. 4A illustrates a portion of the Hanukkiah's body 90 combined with a system for controlling movable members of the Hanukkiah. These include Hanukkah's candles 12A and 12, being moved up and down, and Jewish-related items and symbols, as a Star of David 92. The system includes electromechanical device 52 coupled to other movable members as camshaft 98, elongated candleholders 32E' and 32F', a flexible coupler 96, and rod 40A. The rod passes through opening 50C in body 90. The preferred electromechanical device used is a small, geared, DC electric motor.

While in operation, the electromechanical device turns the camshaft to provide a linear up-and-down motion of the coupled candle holders and hence the candles. Further, it rotates the Star of David.

Support for the camshaft may be included (not shown). Sleeves 100 are used as bearings for the candleholders.

In a further example for visible motion action associated with a Hanukkiah, FIG. 4B illustrates a system for moving a generally ornamental figurine, such as sign 102, in an up-and-down motion. Electromechanical device 52 used is a spring-returned solenoid coupled to a lever system 104.

In a non-operative state, sign 102 is shown below exterior of main body 90, thus being invisible to the observing eye. Upon activation, e.g., when a lit shamash candle is inserted in its holder and/or RF detected, the sign is projected upwards, through an elongated opening 50D in the main body, thus exposing it, as illustrated by broken lines. The sign shown displays a simple "Happy Hanukkah" blessing. The sign is lowered when, say, the playback stops and the solenoid is disengaged. The sign and Star of David, as well as the other movable members, may be made of plastic, metal, etc.

To summarize, FIGS. 4A and 4B illustrate more examples for providing visual motion displays associated with the Hanukkiah. Such displays are achieved by incorporating a variety of movable members in the Hanukkiah and controlling them with the electromechanical device. Unlimited possibilities exist for providing such visual motion associated with the Hanukkiah.

Alternative Sense Circuits—FIGS. 5*b* to 5*e*

As an alternative to sense circuit 16A and/or 16B shown in FIG. 5A, or in addition to, FIGS. 5B to 5E show other sense circuits, more building blocks, adapted to respond to different stimuli in order to trigger the Hanukkiah's output circuit 18. The output of these sense circuits is referenced as on line 110A.

Figure 5B:
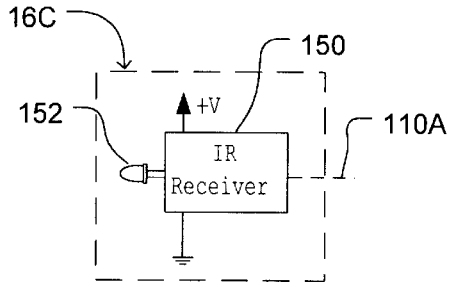
FIGS. 5B to 5E show alternative sense circuits.

FIG. 5B illustrates an IR receiver circuit 16C adapted to respond to a predetermined (non-flame) coded, pulsed, modulated or carrier IR signal from a predetermined remote source. An IR detector 152 is used coupled to an IR receiver 150 for detecting predetermined IR light received and providing a receiver output. The IR detector is preferably an IR transistor detector (as in preferred sensor 60). It is shown disposed in opening 50E, FIG. 3A and FIG. 3C, now away from a candle's flame so not to be influenced by it, and in the front portion of the Hanukkiah facing outwardly.

IR receiver 150 may include a decoder (not shown) for decoding any data transmitted over the IR signal. The decoded data can be used to simply trigger output circuit 18 into operation, or to selectively control the output circuit operation using control circuit 130 and its various outputs, as previously described.

The IR receiver (and decoder) may be selected from the family of commercially available IR remote control ICs and circuitry, and/or from any combination of transistor circuits, logic circuits, microcontroller, etc.

Figure 5C:
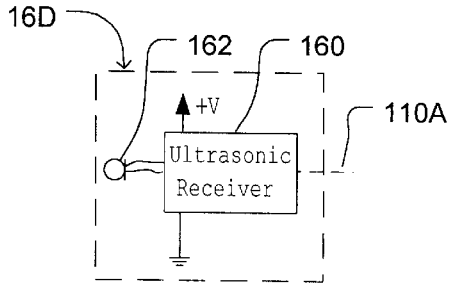

FIG. 5C illustrates an ultrasonic receiver circuit 16D adapted to respond to ultrasonic sounds from a predetermined remote source. An ultrasonic transducer 162 is used coupled to an ultrasonic receiver 160. The circuit outputs a receiver output signal when incoming ultrasonic sounds (20–60 KHz) are above a predetermined pressure level. The transducer may be disposed in opening 50E, FIG. 3A and FIG. 3C. The components and circuitry for ultrasonic detection are known and commercially available.

Figure 5D:
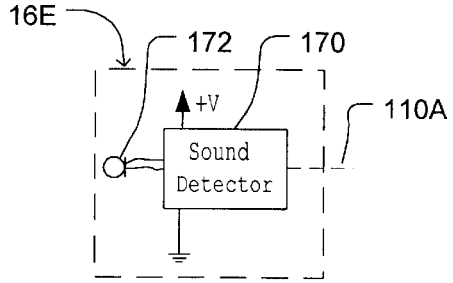

FIG. 5D illustrates an audible sound-responsive circuit 16E adapted to respond to predetermined audible sounds, as hand clapping, music, or voice sounds. A sound transducer 172 is used coupled to a sound detector 170. The circuit is made to respond to incoming sound waves above a predetermined pressure level. The sound transducer may comprise an audio range microphone. The transducer may be disposed in opening 50E, FIG. 3A and FIG. 3C. The components and circuitry for audio sound detection are known and commercially available.

Figure 5E:
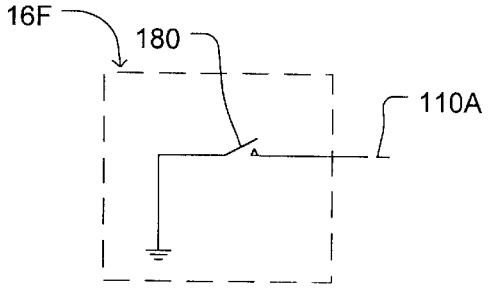

FIG. 5E illustrates a switch circuit 16F comprising a substantially mechanical pressure-sensitive switch 180. It comprises a pushbutton switch—as a tact switch, a toggle switch, a slide switch, a silicon rubber switch, a membrane switch, or similar. It is adapted to respond to a user's touch thereon, or to other physical pressure exerted on predetermined parts of the Hanukkiah. It may preferably be disposed in the Hanukkiah in a manner accessible to the user or in other selected location inside the Hanukkiah (not shown).

Figure 6A:
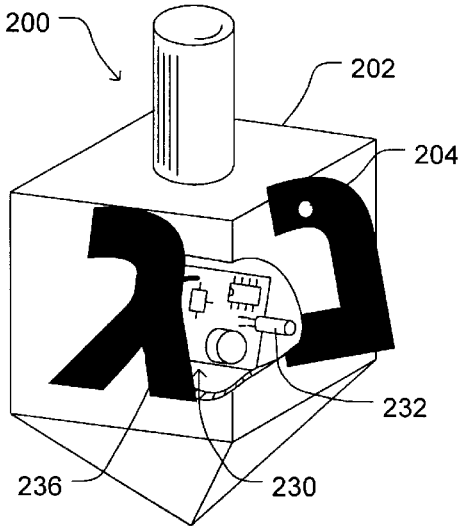
FIG. 6A is an elevation of a dreidel, illustrating internal electronic circuit board.
Figure 6B:
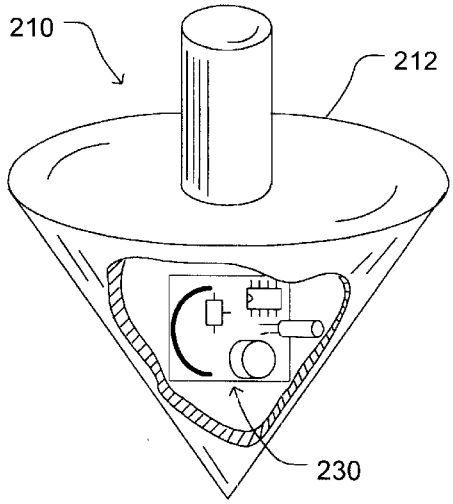
FIG. 6B is an elevation of a general top, illustrating internal electronic circuit board.
Figure 6C:
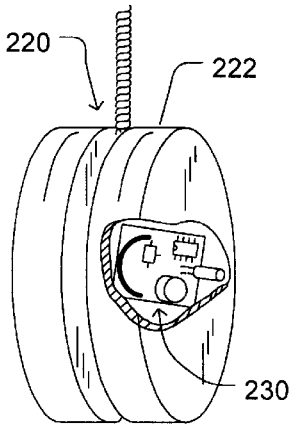
FIG. 6C is a perspective view of a yo-yo, illustrating internal electronic circuit board.
Figure 6D:
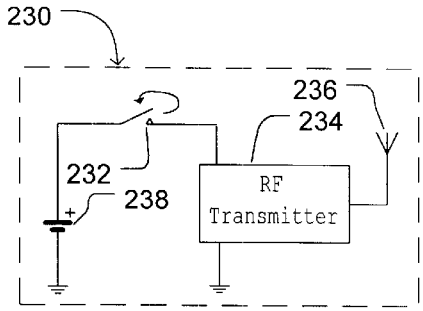
FIGS. 6D–6F show the electronic circuit of the dreidel, top, and yo-yo.

Description—Dreidel-FIGS. 6*a* and 6*d*

FIG. 6A shows dreidel 200 having a traditional Judaic main body 202, usually including four sides (Hebrew letters not shown). In accordance with the invention, in the main body is disposed rotation-sensitive transmitting circuit 230, shown embodied as a small printed circuit board. The circuit is preferably adapted to transmit RF signals. Further shown are embodiments of a centrifugal-switch 232 and an RF antenna 236 of circuit 230. The RF antenna comprising a portion of a (copper) conductor of the printed circuit.

Circuit 230 is tightly secured in main body 202 so to spin as the dreidel spins. It is positioned in a balanced way (not shown) so not to disrupt the dreidel's vertical center-line-of-rotation while spinning, and in consideration of inertia forces. Also, centrifugal-switch 232 preferably is positioned close to the outer perimeter of the main body (not shown), away from the center-line-of-rotation, so to receive maximum centrifugal force while the dreidel is spinning.

FIG. 6D illustrates electrical circuit 230 comprising centrifugal-switch 232, an RF transmitter 234, RF antenna 236, and a transmitter power source 238. The RF antenna is coupled to the output of the RF transmitter, and the centrifugal-switch is connected in series with the power source and the RF transmitter.

Centrifugal-switch 232 preferably comprising a small, normally-open, commercially available mercury-free motion switch, or a similar motion-responsive switch, available from, say, Assemtech Ltd.

The RF transmitter may be selected from the family of commercially available RF remote control transmitter ICs, as used in car alarm remote controls, or from a combination including an RF oscillator and an RF amplifier. The transmitter is adapted to transmit predetermined coded, pulsed, modulated, or carrier RF signals through the antenna.

The antenna may alternatively comprise a loose conducting wire disposed in the dreidel, or similar.

Power source 238 comprising one or more watch-like alkaline battery cells providing, say, 6 VDC.

The dreidel may be made of a variety of materials, such as: glass, wood, plastics, ceramic, clay, stone, metal alloys, brass, gold, silver, etc.

Operation—Dreidel—FIGS. 6*a* and 6*d*

Upon spinning of dreidel 200, centrifugal-switch 232 experiences centrifugal force and responds by electrically switching (closing the circuit) between power source 238 and RF transmitter 234. The transmitter then receives power to generate the predetermined RF signals through the antenna.

The circuit design can provide (not shown) a once-per-spin RF signal, a continuous signal for as long as the dreidel spins, or a signal for a predetermined duration.

Alternative Transmitting-Spinning Devices—FIGS. 6*b* and 6*c*

For associating wireless transmission with playful spinning devices, FIG. 6B shows an example of a spinning top

210 comprising a top main body 212, and containing a circuit 230. Further, FIG. 6C shows an example of a yo-yo device 220 comprising a yo-yo main body 222 containing a circuit 230.

Circuit 230 is arranged in the top and in the yo-yo in a manner described above for the dreidel, and in consideration of the substantially horizontal center-line-of-rotation of the yo-yo. The operation of circuit 230, now disposed in the top and the yo-yo, is equivalent to the operation described above for the dreidel.

The top and yo-yo may be made of a variety of materials, such as: glass, wood, plastics, ceramic, clay, stone, metal alloys, brass, gold, silver, etc.

Figure 6E:
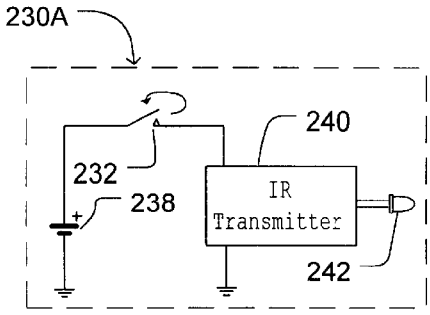
Figure 6F:
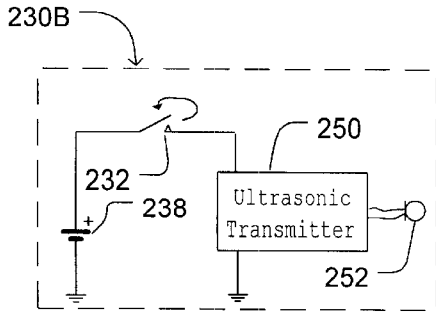

Alternative Transmitting Circuits—FIGS. 6*e* and 6*f*

Alternative rotation-sensitive transmitting circuits can be used. FIG. 6E shows an IR transmitting circuit 230A comprising power source 238, centrifugal-switch 232, an IR transmitter 240, and an IR emitter 242—preferably comprising an IR emitting diode. FIG. 6A shows an optional aperture 204 in the dreidel in which may be disposed emitter 242 for transmitting IR signals to the external of the dreidel.

IR transmitter 240 may be selected from the family of commercially available IR remote control transmitter ICs, as used in TV remote controls, or from any combination of transistor circuits, logic circuits, microcontrollers, etc. The transmitter is adapted to transmit predetermined coded, pulsed, modulated, or carrier IR signals via the IR emitter.

FIG. 6F shows an ultrasonic sound transmitting circuit 230B comprising power source 238, centrifugal-switch 232, an ultrasonic transmitter 250, and an ultrasonic emitter 252. Emitter 252 is disposed in aperture 204 of the dreidel. The components and circuitry for ultrasonic transmitters are known and commercially available.

Operation of the IR and ultrasonic transmitting circuits are equivalent to that described for the RF transmitting circuit 230, allowing for the different transmitters.

The dreidel, top, and yo-yo described may house either of the RF, IR, or ultrasonic signal transmitting circuits. At least one aperture (not shown), similar to aperture 204 of the dreidel, may be formed in the dreidel, top, and yo-yo to house at least one IR emitter or ultrasonic emitter.

Combination of Hanukkiah and Dreidel

When associating the preferred embodiment and operation of the Hanukkiah and dreidel disclosed, a new and exciting product evolves.

The transmitting dreidel and the responsive Hanukkiah are made to communicate using a predetermined RF signal. The dreidel then selectively controls and complements the operation of the Hanukkiah upon spinning.

The two are designed to communicate in, say, a 5 meter or smaller radius. They may alternatively communicate using the IR transmitter/receiver circuit or the ultrasonic transmitter/receiver circuit as described.

(A group of commercially available wireless-communication electronic components and circuits for providing low-cost communication at relatively short distances are available. This group comprises RF, IR, and ultrasonic sound transmitter/receiver circuits, as described previously. In accordance with invention, an RF communication is chosen for its ability to bypass physical obstacles, and its relatively long communication distance.)

Conclusion, Ramifications, and Scope

It will be seen that we have provided a new entertaining device and toy concept. These include a plurality of building blocks to provide such concept. This concept and building blocks are embodied and described in terms of a Hanukkiah and a dreidel pair.

As shown, a Hanukkiah includes a combination of audible and visual effects, and is controlled by a spinning dreidel and other stimuli. This provides new and attractive improvements over the known Hanukkiot and dreidels. Now, for the first time, there is operational association between a dreidel and a Hanukkiah.

While the above description contains many specificities, these should not be construed as limitations on the scope of the invention, but rather as an exemplification of one preferred embodiment thereof. The following are examples of some variations and ramifications:

A Hanukkiah can be provided with simpler/fewer combinations of the building blocks as included and described in the preferred Hanukkiah embodiment. In such case, the control circuit may be avoided. Further, a Hanukkiah with other/alternative or even more combinations of building blocks described can be provided.

Any and all of the flame sensing arrangements may be applicable to any and all the candles used in the Hanukkiah.

Other sensors may be used for initiating entertaining output from a Hanukkiah. These may include a solar-cell, reflective or interruptive optical switches or detectors, vibration or movement sensors, Hall effect sensors, magnetic field detectors, vacuum transducers, air flow detectors, proximity switches, heat-expandable metal alloys, micro-switches, piezo-crystal transducers, a laser detector, etc.

The flame-responsive sensor may be operatively positioned anywhere near a candle's flame, above, below, or to its sides. More than one sensor may be used to sense emissions from any and all the of the candles' flames. Vertically arranged sensors, energy conductors, reflectors etc., with adapted electronics, can be used to detect the diminishing height of a lit candle(s) in order to provide different tunes, motions, or light, as the candle(s) burn down.

The flame-responsive sensor may be positioned relatively low, near, say, the shamash candle holder, to activate or affect any of the output activities when the shamash is nearly consumed.

With the most basic embodiment of the Hanukkiah described, and as disclosed in PPA 60/136,771 referred above, vertical slit 28 may alternatively be a round aperture (no. 18 in PPA), say 3 mm in diameter and slightly inclined downwards, which may include the flame-responsive sensor for detecting the flame of a new lit shamash candle as it is placed in its holder (and not as it consumed). Such configuration may also be used for detecting flames of the day candles.

Optical filters may be added to filter out common household ambient light and allow only preferable IR light to pass from the flame to the sensor.

A solar cell may be used for powering the Hanukkiah's electronics by transforming the candle's light energy into electric energy to charge internal rechargeable batteries. Thus, no replaceable batteries will be required, providing a "greener" Hanukkiah.

Any of the sense circuits may include any combination of transistors, operational amplifiers, comparators, peak detectors, digital logic ICs, microcontroller, and/or DSP, etc., to respond to the coupled sensor(s). Further, any such component may be incorporated in the control circuit and/or output circuit, or selected parts of them.

Any or all components of any of the sense circuits disclosed may be avoided if the input(s) of the control circuit, playback device, and/or any other connected device driver circuit, is sensitive enough, or has built-in specifications and features, so that it may directly respond to the sensor.

The flame-responsive sensor, or energy conductors, may be located high in the Hanukkiah to respond to the flame of a lighter, as a match or a gas lighter, as it is about to light any secured, unlit, candle.

More than one energy conductor, say several fiber optics rods, may be arranged to conduct energies from several flames, or locations, into a single flame-responsive sensor.

Other arrangements may be used for detecting a lit candle for as long as it burns.

A potentiometer adjustment for adjusting the sensitivity of a sense circuit may be incorporated to allow the user to lessen undesired triggering from, say, extreme light or heat surroundings.

The sense circuit, and/or the control circuit, may include a delay circuit to allow some delay between sensing of, say, a flame, and activating the output circuit. Thus, short increases in energy near the sensor, e.g., by a camera's flash light, will not falsely trigger the output circuit into operation.

A sense circuit may include inputs, or be adapted to, condition the issuance of an output sense signal on another predetermined occurrence, whether the occurrence is internal to the Hanukkiah, external, remote, or a combination. Also, such conditioning inputs may be incorporated in the control circuit and/or output circuit.

Any of the RF, IR, ultrasonic, sound, and switch sense circuits, as well as other sense circuits, may be combined in a Hanukkiah together with the flame-responsive circuit. This will allow independent or dependent operation in order to issue a signal(s) to control the output circuit, or any selected part of it.

The sense or control circuits may be adapted to control the output circuit in response to various other occurrences associated with the Hanukkiah, such as: the number of candles used or lighted, the height of the candles, the times that they burn, their arrangement, their color or size, etc. Randomly or sequentially audible and/or visual outputs may be activated in accordance with these variables or events.

The audible and/or visual outputs may be made to activate once or repeatedly, or in any combination or sequence.

A rotary switch or other electronic circuitry may be incorporated to select a preferred musical score out of a plurality preprogrammed in the playback chips.

A potentiometer or similar circuit may be incorporated to allow the user to vary the speed of any motion output associated with the Hanukkiah, and/or to vary the intensity or color of the light output. Alternatively, the sense, control, and/or the visual driver circuit may be modified to include such speed and/or light varying circuitry that are dependent on predetermined conditions.

A clock circuit can be incorporated in the Hanukkiah to provide a time- or date-dependent entertaining output.

The Hanukkiah's power source may be an external or internal AC mains-driven power supply unit.

The electromechanical device may comprise an electric motor (DC, AC, stepper, rotary, linear, geared, vibrator, etc.), a DC or AC solenoid, an electromagnet, a relay, a coil, or any combination.

The electromechanical device may be operatively coupled to any movable member such as: a gear system, a shaft, a propeller—for circulating liquids or gases, a wheel, an asymmetrical wheel, an index wheel, a lever system, a screw-and-bolt system, a rack-and-pinion system, a rolling guide, belts and pulleys, a clutch, a worm gear, flexible motion couplers, a lever system, any movable part of the Hanukkiah body, any Judaic and Hanukkah items and symbols, and any general ornamental items and figurines.

In the output circuit, more than one spinnable dreidel may be used, or other traditional Jewish items, icons, or figurines, or other generally ornamental icons or figurines, may be made to move, be exposed, or changed in form. Also they may be lit or manipulated by light to provide informative and/or entertaining effects from the Hanukkiah.

The Hanukkiah's main body, or any other part associated with it, may comprise an assembly of movable members which are flexibly or rigidly coupled between themselves and movable upon mechanical force exerted or controlled by, say, the electromechanical device. Such movable members are designed to entertain the user, or to provide other predetermined function.

The light source device may comprise an electrical incandescent bulb or lamp, LEDs, a LED array, an LCD display, electroluminescent light, vacuum fluorescent element, neon bulb, a plasma display, an alphanumeric display, a laser diode, a light-effect generator, or any combination.

In a Hanukkiah made of transparent material, such as glass, the light source may be adapted to illuminate the Hanukkiah from within to provide a visual glow as seen from an external viewpoint. The light source may be colored.

Any or all sensing arrangements may be used to trigger, say, an electromechanical device, to mechanically initiate or control the operation of an old-fashioned mechanical music drum wound by the user. Thus, the mechanical music drum is a playback device.

Where possible, any of the inventive features disclosed may be incorporated in electric Hanukkiot and in Hanukkiot for use with floating wicks on oil. For example, a responsive electric Hanukkiah may be used to respond to the transmitting dreidel disclosed, for producing an entertaining output.

In addition to a Hanukkiah, the candelabrum may be a Christian candle holder or a secular candle holder and the humanly sensible output may be a suitable music and a Christian symbol (such as a crucifix or a Christmas artifact) or any secular symbol.

The product concept and building blocks disclosed may be combined in other devices that are known in the arts, or that may be conceived from the knowledge disclosed herein. For example, the method and circuitry disclosed for a rotation-sensitive transmitting circuit may be incorporated in other spinnable or rotational devices and toys, such as Frisbee throwing discs, Hula-Hoop exercise devices, wands, boomerangs, flying saucers, balls of various kinds and sizes, and more. Further, their complementary responsive entertaining devices and toys may include ornamental figurines, candle devices, dolls, puppets, car toys, headsets, Disney figurines, toys, and displays to give spinning competition results, robot toys, new toy designs, and many more.

Other transmitters may be incorporated in the dreidel; such as a laser light transmitter, a flash light transmitter, visible light transmitter, audible sound transmitter, vapor transmitter, electromagnetic microwave transmitter, and more. A matching receiver circuit can then be incorporated in the Hanukkiah (responsive device) for responding to these transmitted circuits.

To increase the likelihood of communication between an IR transmitting dreidel and an IR responsive Hanukkiah when they are at different elevations, two or more IR emitters may be configured in the dreidel with a vertical angle between them. Such a connection increases the vertical angle of the IR signal transmission.

The centrifugal-switch described may alternatively comprise air electrically conducting fixed contact and a movable contact, where the movable contact arranged to make contact with the fixed contact in response to centrifugal force.

Electronics for producing light and sound, as known in prior art, may be incorporated in the dreidel, parallel to its transmitting circuit and using the centrifugal-switch.

Additional electronic components, including sensors, or variations to the components may be incorporated in the dreidel's circuitry to transmit data representative of the dreidel's active status, such as its rotational speed, its elevation, its spinning angle, the overall time it spins, and the direction it spins, etc. This will allow altering its signal generation to provide various entertaining outputs from the Hanukkiah.

Further, continuous changes, ramifications, and improvements are expected to take place to address market preferences and trends.

Accordingly, the scope of the invention should be determined, not by the embodiments illustrated, but by the appended claims and their legal equivalents.

We claim:

1. A responsive device for use with a Hanukkiah which can receive removable candles, comprising:

(a) at least one sensor, arranged to respond to a portion of energy emitted by a flame of at least one lighted candle on a Hanukkiah, for supplying a sensor output, (b) an output device operatively coupled to said sensor output for supplying a humanly sensible indication, said output device comprising at least one of the following:

(1) an electromechanical device adapted and arranged to control at least one humanly detectable motion associated with said Hanukkiah, said electromechanical device being selected from the group consisting of electric motors and solenoids, and (2) an electric light-producing device.

2. The responsive device of claim 1, further including at least one movable member, said electromechanical device being operatively coupled to said movable member, said movable member comprising an item or symbol selected from the group consisting of a Hannukah item or symbol, a Jewish item, a Jewish symbol, and an ornamental figurine.

3. A responsive device for a Hanukkiah which can receive removable candles, comprising:

(a) at least one sensor, arranged to respond to a portion of energy emitted by a flame of at least one lighted candle of a Hanukkiah, for supplying a sensor output, (b) an output device operatively coupled to said sensor output for supplying a humanly sensible indication, said output device comprising at least one of the following:

(1) a playback device and a speaker operatively coupled thereto, said playback device and said speaker adapted to supply audible sounds selected from the group consisting of Hanukkah-related melodies, songs, blessings, and prayers, (2) an electromechanical device adapted and arranged to control at least one humanly detectable motion associated with said Hanukkiah, and (3) an electric light-producing device, and (c) a receiver circuit adapted to respond to a predetermined signal for providing a receiver output, said receiver circuit being selected from the group consisting of radio-frequency, infra-red, and ultrasonic sound receiving circuits, said receiver output being operatively coupled to said output device for operational control thereof.

4. The responsive device of claim 3, further including a rotation-sensitive transmitting device for generating said predetermined signals, said transmitting device comprising:

(a) centrifugal actuation means for providing electrical switching in response to centrifugal force experienced by said centrifugal actuation means, (b) signal generation means for generating said predetermined signals in response to actuation thereof from said centrifugal actuation means, said signal generation means comprising a power source and a transmitter, said transmitter being selected from the group consisting of radio-frequency, infra-red, and ultrasonic sound transmitters, said centrifugal actuation means being connected between said power source and said transmitter, and (c) an enclosure which holds said centrifugal actuation means and said signal generation means, whereby, upon spinning, rotation, or revolution of said enclosure, it will emit signals for controlling said output device.

5. The responsive device of claim 4 wherein said enclosure is selected form the group consisting of dreidels, tops, yo-yos, and spinning devices.

6. The responsive device of claim 3 wherein said sensor output of said sensor and said receiver output of said receiver circuit are coupled in a logic AND circuit to control said output device when both said flame is detected and said predetermined signals are received.

7. An active Hanukkah candelabrum for supplying an audio, visual, or moving output therefrom, comprising:

(a) a Hanukkiah for holding up to nine removable candles thereon, (b) an output device for providing said audio, visual, or moving output in response to a sense output, and (c) a sense circuit operatively coupled to said output device for providing said sense output for controling said output device, said sense circuit comprising a receiver circuit responsive to predetermined signals from a predetermined remote source, said receiver circuit being selected from the group consisting of radio-frequency, infra-red, and ultrasonic-sound receiver circuits, whereby said audio, visual, or moving output will be provided in response to said sense circuit.

8. The active Hanukkah candelabrum of claim 7 wherein said predetermined remote source is a rotation-sensitive transmitting device, said transmitting device comprising:

(a) centrifugal actuation means for providing electrical switching in response to centrifugal force applied thereto by spinning thereof, (b) signal generation means for generating said predetermined signals in response to actuation thereof from said centrifugal actuation means, said signal generation means comprising a power source and a transmitter, said transmitter being selected from the group consisting of radio-frequency, infra-red, and ultrasonic sound transmitters, said centrifugal actuation means being connected between said power source and said transmitter, (c) an enclosure, said enclosure holding said centrifugal actuation means and said signal generation means, whereby upon spinning, rotation or revolution of said enclosure, it will emit signals to be received by said Hanukkiah for controlling its output device, thereby controlling said Hanukkiah from a distance.

9. The active Hanukkah candelabrum of claim 8 wherein said enclosure is selected form the group consisting of dreidels, tops, yo-yos, and spinning devices.

10. A playful rotation-sensitive device, comprising:

(a) centrifugal actuation means for providing electrical switching in response to centrifugal force experienced thereby, (b) signal generation means for generating a signal in response to actuation thereof from said centrifugal actuation means, said signal generation means comprising a power source and a transmitter, said centrifugal actuation means being connected between said power source and said transmitter, (c) an enclosure, said enclosure holding said centrifugal actuation means and said signal generation means, said enclosure being selected form the group consisting of dreidels, tops, yo-yos, and spinning devices, whereby upon spinning, rotation or revolution of said enclosure, it will emit said signal.

11. The playful rotation-sensitive device of claim 10, further including a responsive device adapted to respond to said signal from said rotation-sensitive device to provide a humanly sensible indication in response thereto, said responsive device comprising:

(a) a receiver circuit adapted to respond to said signal from said rotation-sensitive device for providing a receiver output, (b) an output device, operatively coupled to said receiver circuit, for providing said humanly sensible indication in response to said receiver output, and (c) an enclosure comprising a Hanukkiah, said Hanukkiah holding said receiver circuit and said output device therewithin, whereby upon receiving of said signals from said rotation-sensitive device, said Hanukkiah will emit said humanly sensible indication.

12. A playful rotation-sensitive device, and a responsive device for communicating therewith and providing a humanly sensible indication therefrom, comprising:

(a) a rotation-sensitive device comprising:

(1) centrifugal actuation means for providing electrical switching in response to centrifugal force applied thereto by spinning thereof, (2) signal generation means for generating signals in response to actuation thereof from said centrifugal actuation means, said signal generation means comprising a power source and a transmitter, said centrifugal actuation means being connected between said power source and said transmitter, and (3) a first enclosure, said first enclosure holding said centrifugal actuation means and said signal generation means, said first enclosure being selected form the group consisting of dreidels, tops, yo-yos, and spinning devices, and (b) a responsive device comprising:

(1) a receiver circuit adapted to respond to said signals from said rotation-sensitive device for providing a receiver output, (2) an output device operatively coupled to said receiver circuit for providing said humanly sensible indication in response to said receiver output, and (3) a second enclosure which holds said receiver circuit and said output device, whereby upon spinning, rotation, or revolution of said first enclosure, it will emit signals responsive by said second enclosure for controlling said output device, thereby providing said humanly sensible indication.

* * * * *